US009855454B2

(12) United States Patent
Ismail et al.

(10) Patent No.: US 9,855,454 B2
(45) Date of Patent: Jan. 2, 2018

(54) PORTABLE EXERCISE MACHINE

(75) Inventors: Said Abdow Ismail, Scarborough (CA); Isaak R. Jama, Bristow, VA (US)

(73) Assignee: Said A. Ismail, Scarborough (CA)

( * ) Notice: Subject to any disclaimer, the term of this patent is extended or adjusted under 35 U.S.C. 154(b) by 0 days.

(21) Appl. No.: 11/896,140

(22) Filed: Aug. 30, 2007

(65) Prior Publication Data

US 2009/0062088 A1 Mar. 5, 2009

(51) Int. Cl.

| | |
|---|---|
| ***A63B 21/02*** | (2006.01) |
| ***A63B 21/00*** | (2006.01) |
| ***A63B 21/055*** | (2006.01) |
| ***A63B 23/12*** | (2006.01) |
| ***A63B 21/062*** | (2006.01) |
| *A63B 21/04* | (2006.01) |
| *A63B 23/02* | (2006.01) |
| *A63B 23/035* | (2006.01) |

(52) U.S. Cl.

CPC .... *A63B 21/00043* (2013.01); *A63B 21/0004* (2013.01); *A63B 21/0552* (2013.01); *A63B 21/0628* (2015.10); *A63B 21/154* (2013.01); *A63B 21/4007* (2015.10); *A63B 21/4009* (2015.10); *A63B 21/4025* (2015.10); *A63B 23/03541* (2013.01); *A63B 23/12* (2013.01); *A63B 23/1209* (2013.01); *A63B 21/0442* (2013.01); *A63B 21/0557* (2013.01); *A63B 21/4035* (2015.10); *A63B 23/0211* (2013.01); *A63B 23/0233* (2013.01); *A63B 23/03533* (2013.01); *A63B 2210/50* (2013.01)

(58) Field of Classification Search

CPC ..... A63B 21/0552
USPC ..... 482/124
See application file for complete search history.

(56) References Cited

U.S. PATENT DOCUMENTS

| | | | | |
|---|---|---|---|---|
| 5,842,959 | A * | 12/1998 | Wilkinson | A41D 13/0015 2/69 |
| 5,916,070 | A * | 6/1999 | Donohue | A63B 21/151 482/114 |
| 6,659,921 | B2 * | 12/2003 | Vernon | A63B 21/4025 482/114 |
| 6,691,318 | B1 * | 2/2004 | Davis | A63B 21/0004 2/102 |
| 6,837,832 | B2 * | 1/2005 | Hanners | A63B 21/065 482/105 |

* cited by examiner

*Primary Examiner* — Lori Baker
(74) *Attorney, Agent, or Firm* — Aird & McBurney LP

(57) ABSTRACT

A portable, light-weight exercise apparatus includes a jacket made light-weight material and coated with low surface friction coating, and can be worn on the user's upper body. The jacket having an upper protuberance member and a lower protuberance member, each with an aperture for engaging a pair of resistance cables that are respectively connected to a pair of grip handles. Depending on the desired exercise of certain muscle groups, the user engages resistance cables in either the lower protuberance member, or the upper protuberance member. In another embodiment, the jacket comprises of two track-like members means placed on the back-side of the jacket, for adjusting the resistance cables, and a single protuberance member where the resistance cables are secured therein.

18 Claims, 8 Drawing Sheets

PORTABLE EXERCISE MACHINE

BACKGROUND OF THE INVENTION

Field of the Invention

The present invention relates generally to an apparatus for performing upper body exercises and more particularly, to a portable exercise apparatus ideal for both indoor and outdoor use which and includes a jacket with shoulder/chest harness, interchangeable resistance cables and a set of grip handles in order to perform a variety of exercises.

Description of Related Art

Nowadays, the public is cognizant of the connection between physical exercise and good health. As such, stationary exercise equipment, as well as certain portable ones is prevalent in gymnasiums, schools and individual homes. In addition, physicians and other medical personal advise the public to be aware of the advantages of proper diet and exercise in maintaining a healthy lifestyle. Because of the public being informed of health matters, an increasing number of people closely monitor their diet and participate in some form of physical exercise in order to maintain good health and increase their chances of living a longer healthy life. The myriad of exercise equipment available to the public include cable machines for weight training or functional training.

Functional training has been developed by physical therapists, imitating physical activities of daily life. It involves mainly weight-bearing activities targeted at core muscles of the upper torso, and is geared towards better muscular balance and joint stability in order to get better performance of any activity, and to lessen the occurrence of injuries. In comparison, weight training targets to isolate particular muscles, i.e. biceps, triceps, abdominal muscles etc. functional training can be accomplished using a number of different exercise motions using either free weights, such as dumbbells and barbells, or using cable machines to facilitate the various exercise motions.

A cable machine is an item of equipment used in weight training or functional training. FIG. 1 is an illustration of a cable machine. Because of its size, the cable machine may only be placed in a gymnasium or in a home with enough space. As shown in FIG. 1, the machine consists of a rectangular, vertically-oriented steel frame 110, which is about 10 feet wide and 7 feet high, with a weight stack at each end 120. A pair of cables 130 is connected to handles 140 to the weight stacks run through a number of adjustable pulleys 150 that may be fixed at any height. This allows a variety of exercises to be performed on the apparatus. On either end of the cable, attached is a perforated steel plate that runs down the center of the weight stack, in order to allow the user to the select the desired amount of resistance. Most cable machines have a minimum of 20 pounds of resistance in order to counter-balance the weight of a typical attachment. As can be seen from FIG. 1, such a machine is typically stationary and can only be placed indoors in a large enough room.

Thus, for portable equipments that can be used in both outdoor and indoor, currently there is a shortage of such exercise equipments; it is advantageous to have an exercise equipment that combines as many exercises into a single exercise machine. Therefore, a need exists for an exercise machine that allows an exerciser to perform a number of upper torso exercises in both indoors and outdoors. In addition, for such an exercise machine, it will be advantageous for it to be portable as well as light weight. It is also desirable for such an exercise machine to be a low cost machine, while still maintaining the advantages and feel of traditional exercise motions, such as the bench press, the dumbbell press, and the dumbbell fly, with the added safety of performing such exercises on an exercise machine.

Unfortunately, there are no alternatives to the cable machines in existence today when it comes to complete functional training equipment. In addition, portability of such exercise equipments is almost non-existent.

SUMMARY OF THE INVENTION

In view of the foregoing disadvantages inherent in the known types of gym apparatus now present in the prior art, the present invention provides a portable multi-exercise gym apparatus, small enough and light enough for indoor as well as outdoor activities. As such, the general purpose of the present invention, which will be described subsequently in greater detail, is to provide a new and improved gym exercise apparatus that has all the advantages of the prior art gym apparatus and none of the disadvantages.

The purpose and advantages of the invention will be set forth in and will be apparent from, the description and drawings that follow. Additional advantages of the invention is realized and attained by the elements of the apparatus and methods by using the invention described herein.

While the novel features of the invention are set forth with particularly in the appended claims, the invention, both as to its utility and ease of use, will be better understood and appreciated, along with other objects and features thereof, from the following detailed descriptions taken in conjunction with the drawings.

DETAILED DESCRIPTION OF THE PREFERRED EMBODIMENTS

The following description is intended to convey an understanding of the invention by providing a number of specific embodiments and details involving various applications of the invention. It is understood, however, that the invention is not limited to these embodiments and details, which are only exemplary. It is further understood that one possessing ordinary skill in the art, in light of known apparatuses and methods, would appreciate the use of the invention for its intended purposes and benefits in any number of alternative embodiments, depending upon specific design and other needs.

The jacket of the present invention is constructed from readily available materials. Preferably, the material may be chosen from a light fabric, such as, for example, nylon with a hyper plush, and smooth-skin. In order to minimize friction due to the back-and-forth movement of the nature of the exercises performed by users, the jacket material will be coated with a low surface friction coating, such as a super composite skin, a material available in the market.

Figure 1:
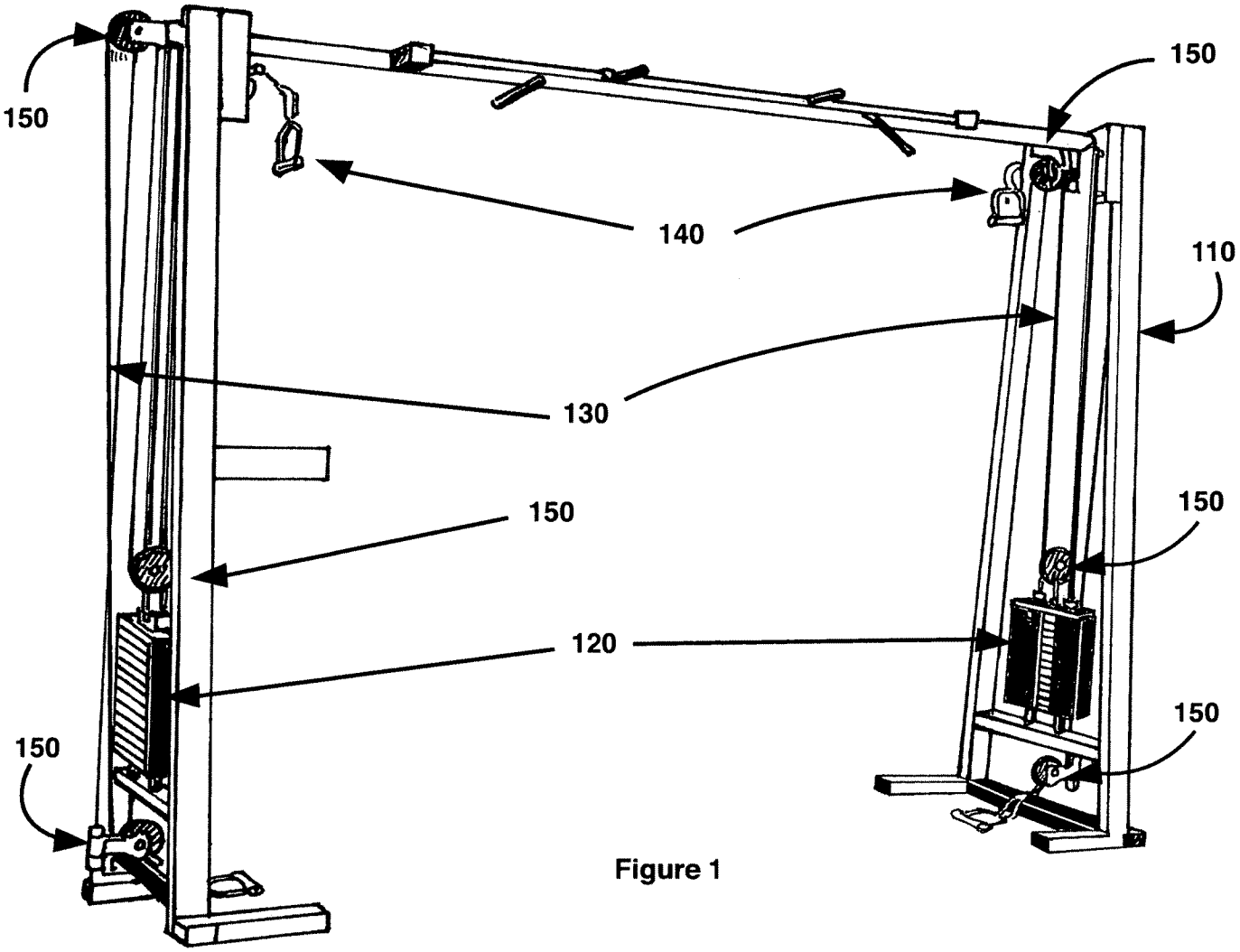
FIG. 1 is a prior art of illustration of a cable machine normally found in gymnasiums.
Figure 2:
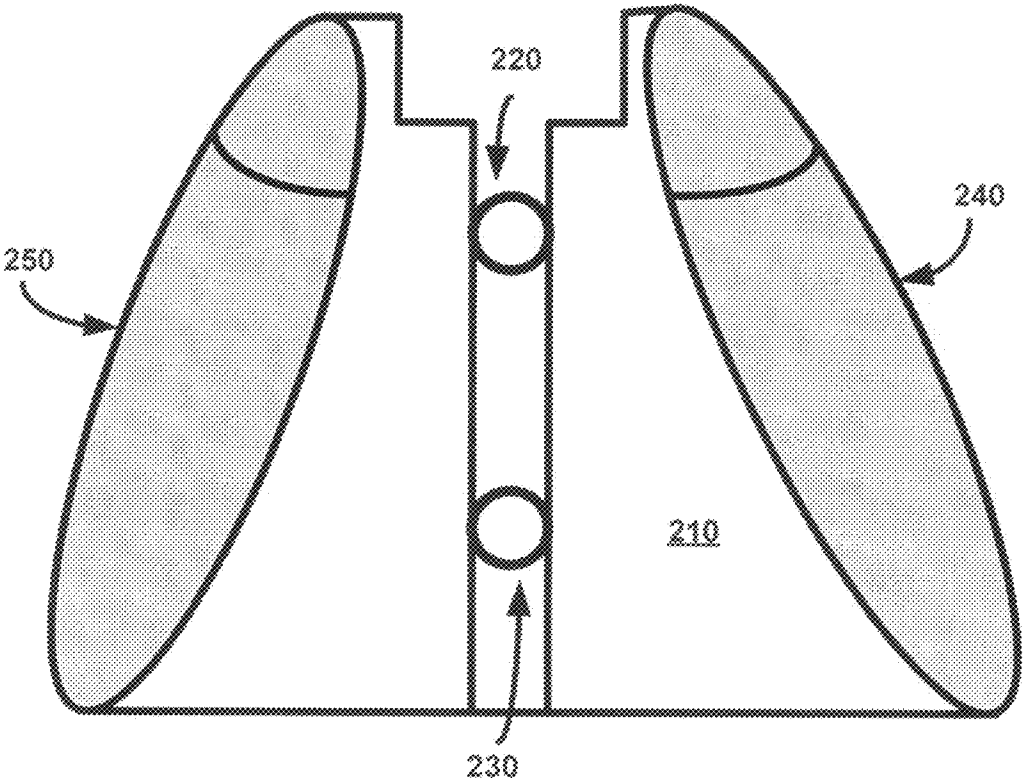
FIG. 2 is a frontal view of the jacket of the present invention.
Figure 3:
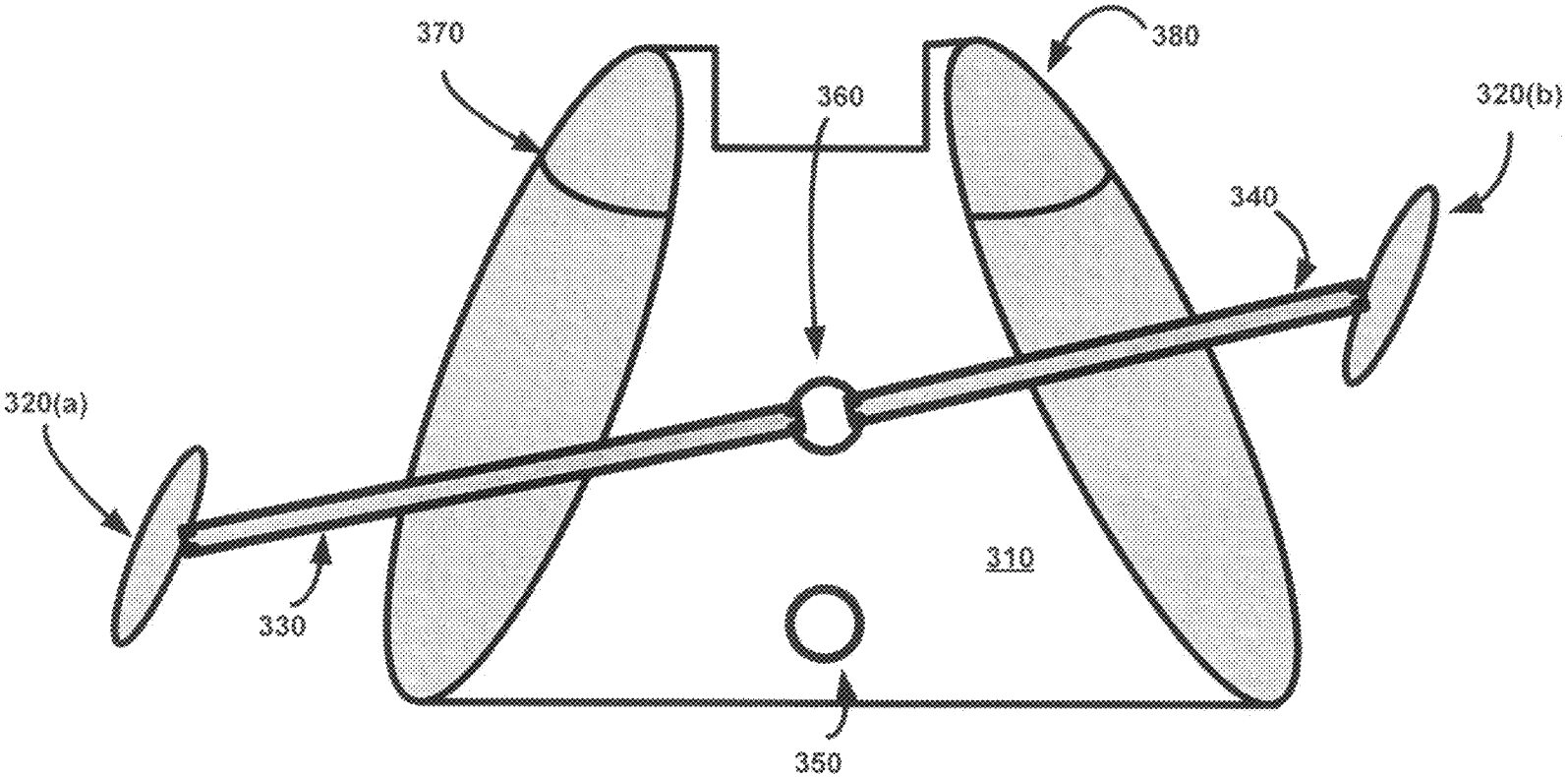
FIG. 3 is a rear view of the jacket according to an embodiment of the present invention.
Figure 4:
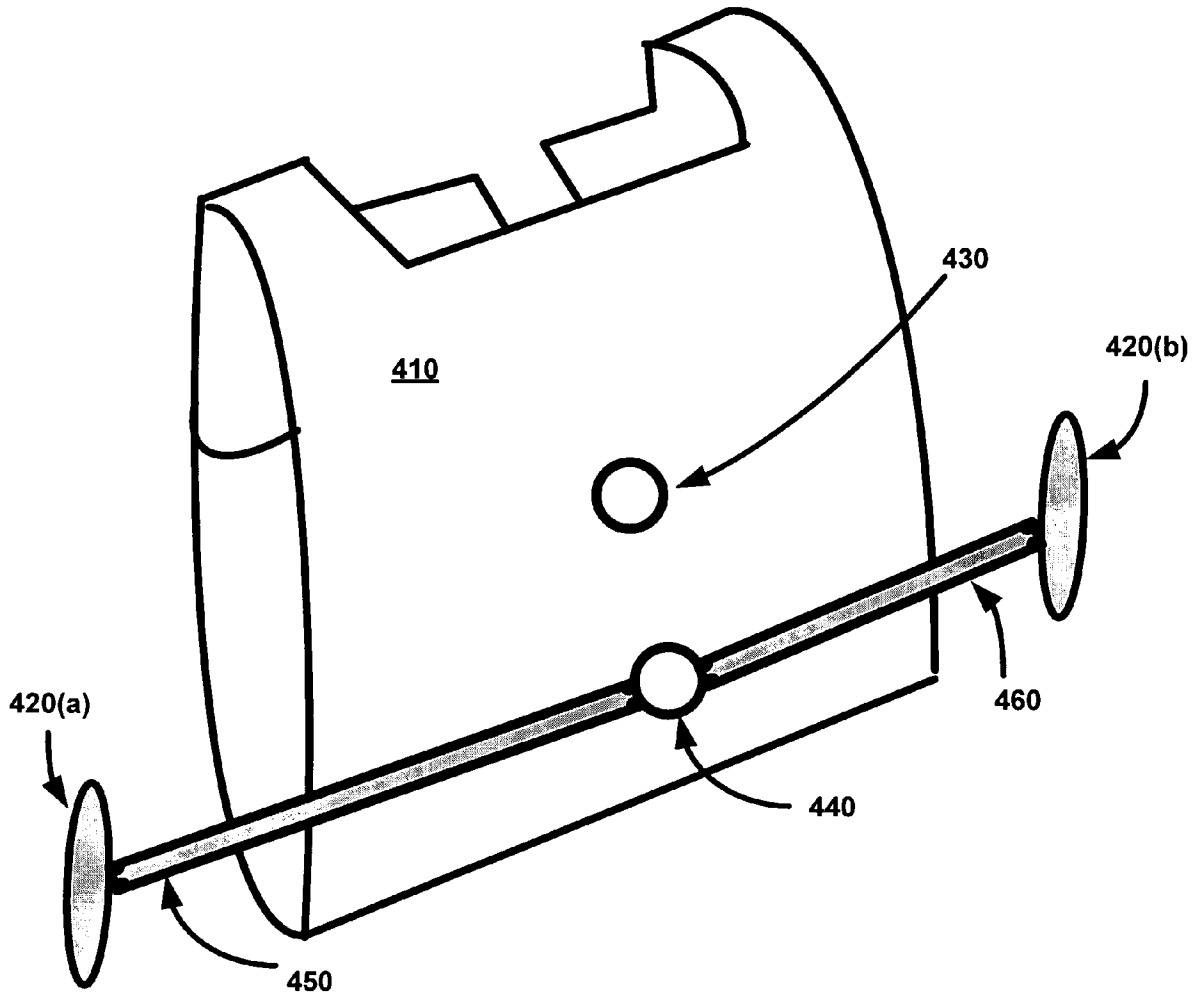
FIG. 4 is a back-side view of the jacket with the resistance cables according to an embodiment of the present invention.
Figure 5:
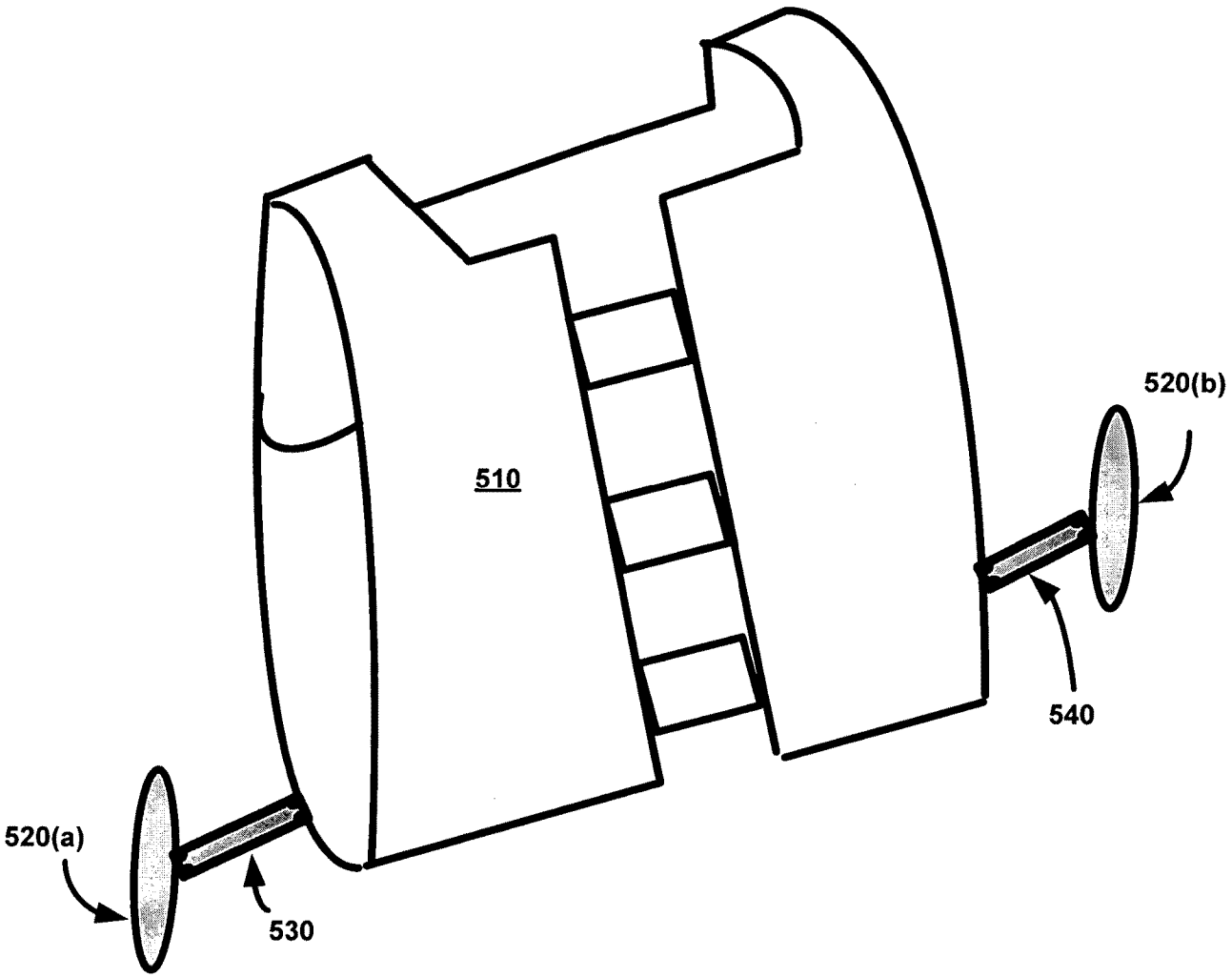
FIG. 5 is a front-side view of the jacket with the resistance cables according to an embodiment of the present invention.
Figure 6:
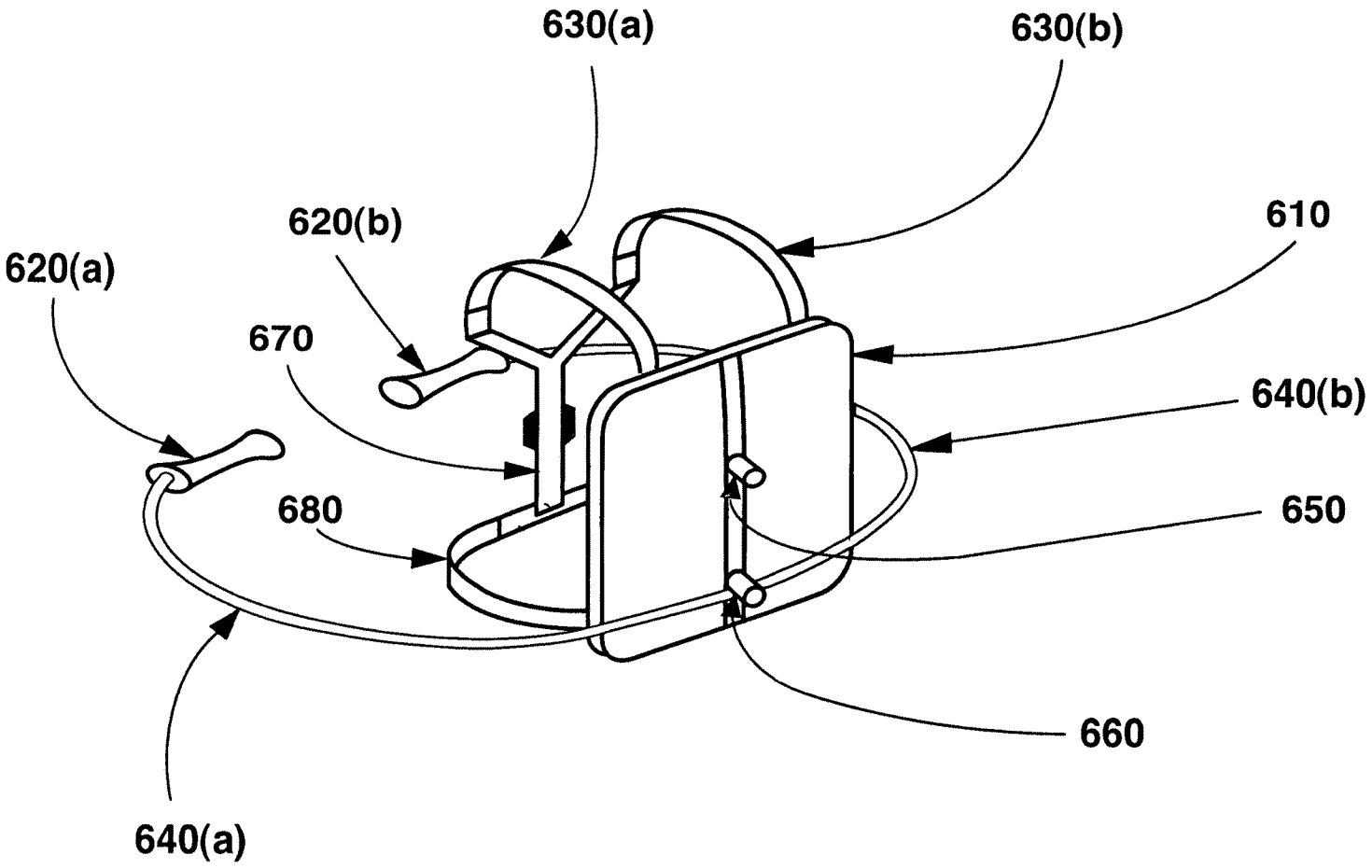
FIG. 6 is a back-side view of the jacket with the resistance cables and the shoulder/chest harness according to an embodiment of the present invention.

With reference now to the drawings, and in particular to FIGS. 2 to 6 thereof, a novel and improved exercise apparatus embodying the principles and concepts of the present invention is referred to generally in FIG. 6 by the reference numeral 600. It should be understood that exercise apparatus 600 may be used to perform many different types of exercises including cardiovascular fitness and, therefore, should not be limited to muscle toning. Through a non-limiting example, a boxer who may be training for an upcoming bout, normally trains by running to increase his/her endurance, and spars in the ring to hone his/her punching skills. By using the exercise apparatus of the current invention, such a boxer may be able to attain both of those skills.

In particular, the portable exercise apparatus 600 of the present invention essentially comprises a jacket 610 that can be worn on the user's upper body, having an upper protuberance member 650 and a lower protuberance member 660, each with an aperture for engaging a pair of resistance cables 640(*a*) and 640(*b*) that are respectively connected to a pair of grip handles 620 (*a*) and 620(*b*). Preferably, in the event a user desires to exercise certain muscle groups such as arm muscles, triceps, deltoids and upper chest muscles, the user engages resistance cables 640(*a*) and 640(*b*) in the lower protuberance member 660. Similarly, for exercising biceps and lower chest muscles, a user engages resistance cables 640(*a*) and 640(*b*) in the upper protuberance member 650.

Figure 7:
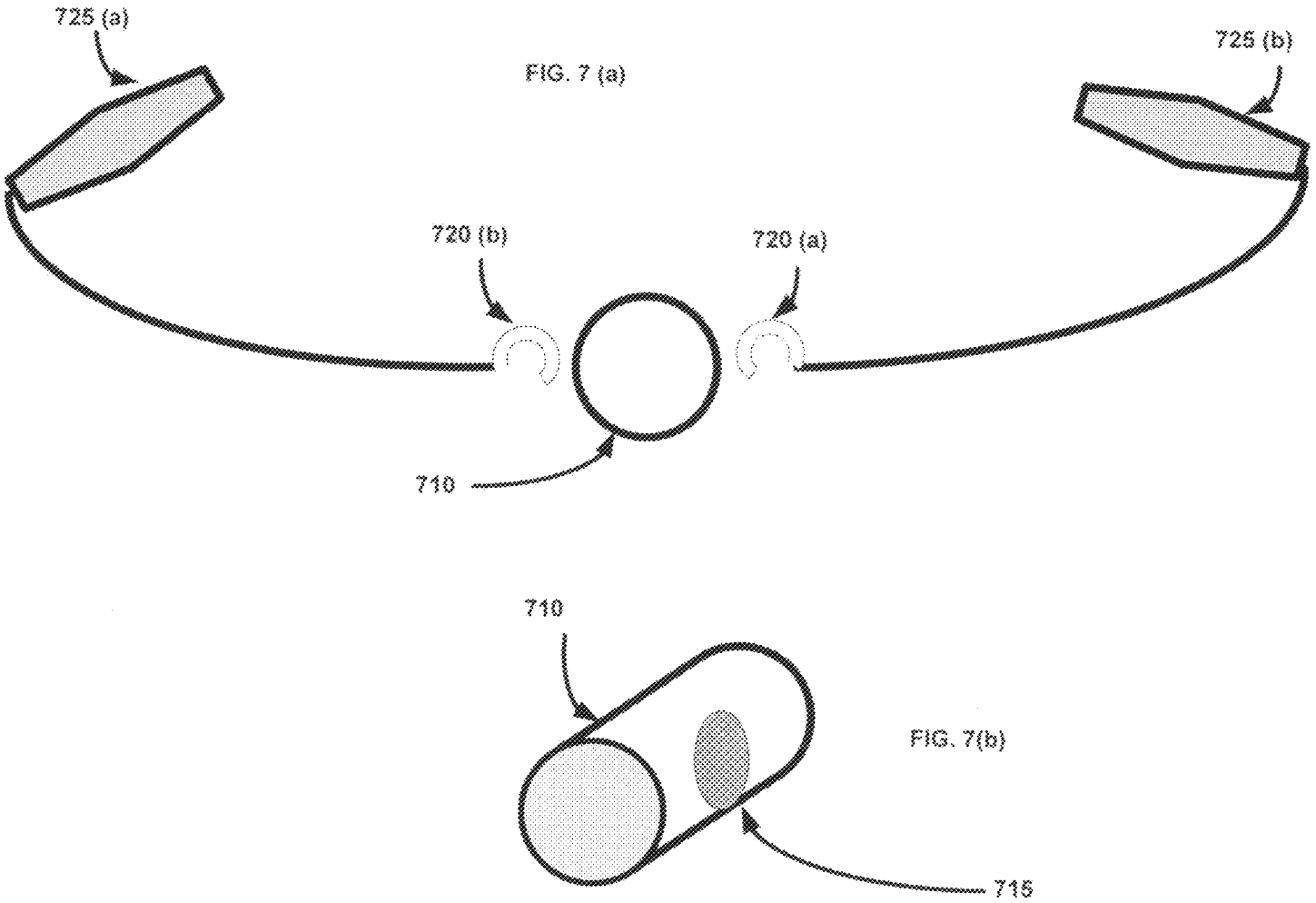
FIGS. 7(*a*) and (*b*) is an illustration of the jacket protuberance member in connection to the resistance cables according to an embodiment of the present invention.

In operation, and as shown in FIGS. 6 and 7, a user (not shown) connects resistance cables 730 (*a*) and (*b*) by placing resistance cable hook 720(*a*) and (*b*) through aperture 715 of either one of the upper or lower protuberance members, which for simplicity is marked 710. After resistance cable hooks 720(*a*) and (*b*) are secured together, the user puts on jacket 610 like a normal vest, and then shoulder straps 630 (*a*) and (*b*), chest strap 670 and mid-section strap 680 are adjusted per the user's fit and comfort level.

Figure 8:
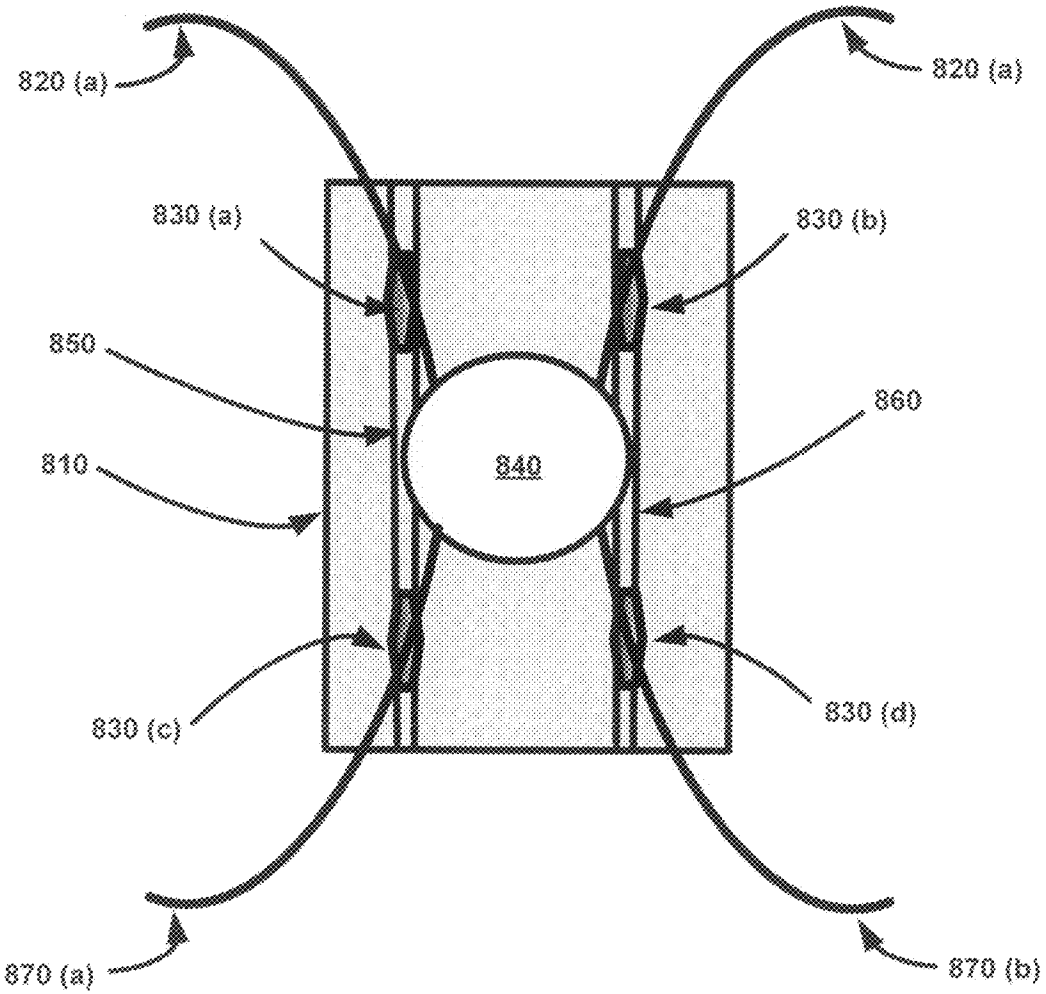
FIG. 8 is a back-side view of the jacket illustrating ways of adjusting the resistance cables to two different positions according to an embodiment of the present invention.

In another embodiment, and in reference to FIG. 8, there is shown means for adjusting the resistance cables (not shown) without taking off the jacket and removing the cables from one position to attach it to another position. Jacket 810 includes two track-like members 850 and 860 with upper depressions 830 (*a*) and 830(*b*) and lower depressions 830 (*c*) and 830(*d*). A single protuberance member 840 where the resistance cables (not shown) are secured therein, slides up and down track members 850 and 860 by pulling cords 820 (*a*) and 820 (*b*) that go over the shoulders of the user, and which are secured on the front side of jacket 810 by Velcro™, and settles in the upper depressions 830 (*a*) and 830(*b*), allowing the user to engage in a set of exercise movement for certain muscles such as abdominals, shoulder muscles, deltoids, upper chest muscles and triceps. And in the event that the user desires to exercise another group of muscles such as, biceps, lower chest muscles, triceps and front/back deltoids, the user pulls on cords 870 (*a*) and 870 (*b*) that go on the side of the user, and which are identically secured on the front side of jacket 810 by Velcro™, allowing protuberance member 840 to settle in the lower depressions 830 (*c*) and 830(*d*) without the user pausing to unhook the resistance cables.

FIGS. 2 to 5 are included in order to illustrate different perspectives of the jacket to further depict the jacket in conjunction with the resistance cables. It should be noted that multiple resistance cables may be employed by a user depending on the desired resistance workout.

While the invention has been described with respect to a certain specific embodiment, it will be appreciated that many modifications and changes may be made by those skilled in the art-without departing from the spirit of the invention. It is intended, therefore, by the appended claims to cover all such modifications and changes that may fall within the true spirit and scope of the invention.

We claim:

1. A light-weight, portable upper body exercise apparatus comprising:

a jacket member constructed from light-weight material, coated with a low surface friction coating, and having shoulder straps, a chest strap, and mid-section strap; said jacket member further comprising at least one protuberance member having an aperture; said at least one protuberance member disposed on a back side of said jacket member;

a first resistance cable having one end removably attached to said at least one protuberance member via said aperture and another end having a grip handle member; a second resistance cable having one end removably attached to said at least one protuberance member via said aperture and another end having a grip handle member; and wherein said first resistance cable and said second resistance cable are independent of each other.

2. The apparatus of claim 1, wherein the shoulder straps, a chest strap, and mid-section strap are adjustable for a user's comfort and fit.

3. The apparatus of claim 1, wherein the user engages at least one of said resistance cables in said at least one protuberance member for exercising arm muscles, triceps, deltoids, abdominals and upper chest muscles.

4. The apparatus of claim 1, wherein the user engages at least one of said resistance cables in said at least one protuberance member for exercising biceps and lower chest muscles, front and back deltoids and triceps.

5. The apparatus of claim 1, further comprising a plurality of resistance cable members with varying resistance employable by a user depending on the desired resistance workout.

6. A light-weight, portable upper body exercise apparatus comprising:

a jacket constructed from light-weight material, coated with a low surface friction coating, and having shoulder straps, a chest strap, and mid-section strap; said jacket member further comprising, a pair of track strips each with a lower and an upper depression, and a single protuberance member having two pairs of cords, said single protuberance member slidable along said pair of track strips and an aperture for engaging a pair of resistance cables that are respectively connected to a pair of grip handle members.

7. The apparatus of claim 6, wherein the user pulls on one set of said cords for engaging said resistance cables by placing said protuberance member in the upper depressions of said track strips for exercising arm muscles, triceps, deltoids, abdominals and upper chest muscles.

8. The apparatus of claim 6, wherein the user pulls on one set of said cords for engaging said resistance cables by placing said protuberance member in the lower depressions of said track strips for exercising biceps and lower chest muscles, front and back deltoids and triceps.

9. The apparatus of claim 1, wherein the low surface friction coating is a super composite skin.

10. The apparatus of claim 6, wherein the low surface friction coating is a super composite skin.

11. The apparatus of claim 3, wherein said at least one protuberance member is positioned on said jacket member adjacent to a lower section of said jacket member.

12. The apparatus of claim 4, wherein said at least one protuberance member is positioned on said jacket member adjacent to an upper section of said jacket member.

13. The apparatus of claim 1, wherein said first resistance cable and said second resistance cable are attached to the same said at least one protuberance member.

14. An upper body exercise apparatus comprising:

a jacket member for securement to said upper body of a user, said jacket member comprising a lower protuberance member with a first aperture and an upper protuberance member with a second aperture, said lower protuberance member and said upper protuberance member disposed on a back side of said jacket member;

a first resistance cable having one end with a hook member and another end with a grip handle member;

a second resistance cable having one end with a hook member and another end having a grip handle member; and wherein said first resistance cable and said second resistance cable are independently removably attached to one of said apertures, and independently operable of each other.

15. The apparatus of claim 14, wherein said user engages said resistance cables in said lower protuberance member for exercising a first set of muscle groups.

16. The apparatus of claim 14, wherein said user engages said resistance cables in said upper protuberance member for a second set of muscle groups.

17. The apparatus of claim 14, wherein comprising a plurality of interchangeable resistance cables with varying resistance employable by a user depending on the desired resistance workout.

18. The apparatus of claim 14, wherein said first resistance cable and said second resistance cable are removably attached to the same aperture.

* * * * *